US005640922A

United States Patent [19]

Feldkamp et al.

[11] Patent Number: 5,640,922

[45] Date of Patent: Jun. 24, 1997

[54] HANDS FREE DIVE FLAG CONNECTOR

[76] Inventors: Alan Feldkamp, 6524 Chowen Ave. North, Brooklyn Center, Minn. 55429; Tim Scully, 2626 Emerson Ave. South, Minneapolis, Minn. 55408

[21] Appl. No.: 519,345

[22] Filed: Aug. 25, 1995

[51] Int. Cl.[6] ..... B63C 11/46

[52] U.S. Cl. ..... 114/315; 441/6; 441/26

[58] Field of Search ..... 441/1, 6, 11, 23–26, 441/75; 114/315; 405/186; 242/404, 404.1, 405.1; 224/162; 119/796

[56] References Cited

U.S. PATENT DOCUMENTS

| | | | |
|---|---|---|---|
| 3,705,697 | 12/1972 | Chagnon | 242/404.1 |
| 3,907,236 | 9/1975 | Sims, Jr. | 242/404.1 |
| 4,014,478 | 3/1977 | Bonacina | 441/26 |
| 4,610,634 | 9/1986 | Kimura | 441/75 |
| 4,732,305 | 3/1988 | Courtney et al. | 405/186 |
| 5,173,067 | 12/1992 | Biba | 441/26 |

FOREIGN PATENT DOCUMENTS

| | | | |
|---|---|---|---|
| 2671047 | 7/1992 | France | 405/186 |

*Primary Examiner*—Edwin L. Swinehart

*Attorney, Agent, or Firm*—Palmatier, Sjoquist, Helget & Voigt, P.A.

[57] ABSTRACT

The present invention is a hands free dive flag connector comprising a retractable lanyard dispenser releasably attached to dive gear on a scuba diver. Complementary hook and loop materials are attached to the dive gear and the retractable lanyard dispenser to form a releasable connection between the diver and the hands free dive flag connector. A lanyard is retractably wound on a spool in the retractable lanyard dispenser and attached to the spool at a dispenser end. A spring in the retractable lanyard dispenser maintains tension on the lanyard between the diver and the dive flag attached to the lanyard. A lanyard connecter is attached to the second end of the lanyard adjacent to an extended lanyard portion extending from the lanyard dispenser. The lanyard connecter attaches to the dive flag.

15 Claims, 4 Drawing Sheets

HANDS FREE DIVE FLAG CONNECTOR

BACKGROUND OF THE INVENTION

The present invention relates to devices for connecting a scuba diver to a scuba dive flag. Prior art devices comprised a simple lanyard or rope with one end connected to the dive flag and the other end held by the diver.

The prior art devices created awkward and possibly dangerous conditions for the diver due to managing a length of rope when the diver was not diving at a depth equal to the length of the rope.

Prior art devices also had a problem associated with connection the lanyard to the diver. The diver could be injured or killed if the rope was connected to the divers body or diving gear and the rope picked up by an object passing the position of the diver.

It can be understood that if the dive flag rope was connected to the diver and a passing boat snagged the rope, the diver would be dragged through the water and possibly be confronted with a boat propeller. Alternatively, if the diver is in a river or other moving body of water and the flag snagged on tree or other stationary object, the diver could be held underwater by the force of the moving water.

The present invention solves these problems and others as will be obvious.

SUMMARY OF THE INVENTION

The present invention is a hands free dive flag connector comprising a retractable lanyard dispenser releasably attached to dive gear on a scuba diver. Complementary hook and loop materials are attached to the dive gear and the retractable lanyard dispenser to form a releasable connection between the diver and the hands free dive flag connector. A lanyard is retractably wound on a spool in the retractable lanyard dispenser and attached to the spool at a dispenser end. A spring in the retractable lanyard dispenser maintains tension on the lanyard between the diver and the dive flag attached to the lanyard. A lanyard connecter is attached to the second end of the lanyard adjacent to an extended lanyard portion extending from the lanyard dispenser. The lanyard connecter attaches to the dive flag.

An advantage of the present invention is it may be releasably attached to a diver's dive gear.

A further advantage of the present invention is the lanyard has a constant tension on the extended lanyard portion to prevent interference with the diver.

A further advantage of the present invention is it may be practiced with a standard scuba dive flag.

Another advantage of the present invention is the hands free dive flag connector is simple and inexpensive.

A still further advantage of the invention is it may be removed from the dive gear for easy storage and transport.

A further advantage of the invention is it may be adapted to existing dive gear.

Another advantage of the invention is it may be used at additional depths with a lanyard extension.

Another advantage of the invention is it may be made from rust resistant materials.

A feature of the invention is the retractable lanyard dispenser may be mounted on the dive gear and/or on the dive flag.

A further feature is the retractable lanyard dispenser uses complementary hook and loop materials to releasably connect to dive gear.

A further feature is the retractable dispenser may use alternate releasable connection means having a predetermined release force.

Another feature of the invention is a lanyard extension to extend the depth a diver may travel from the dive flag.

Another feature of the invention is a dive gear ring releasably attached to the dive gear, the dive gear ring connected to the lanyard to connect the diver to the dive flag.

DETAILED SPECIFICATION

Figure 1:
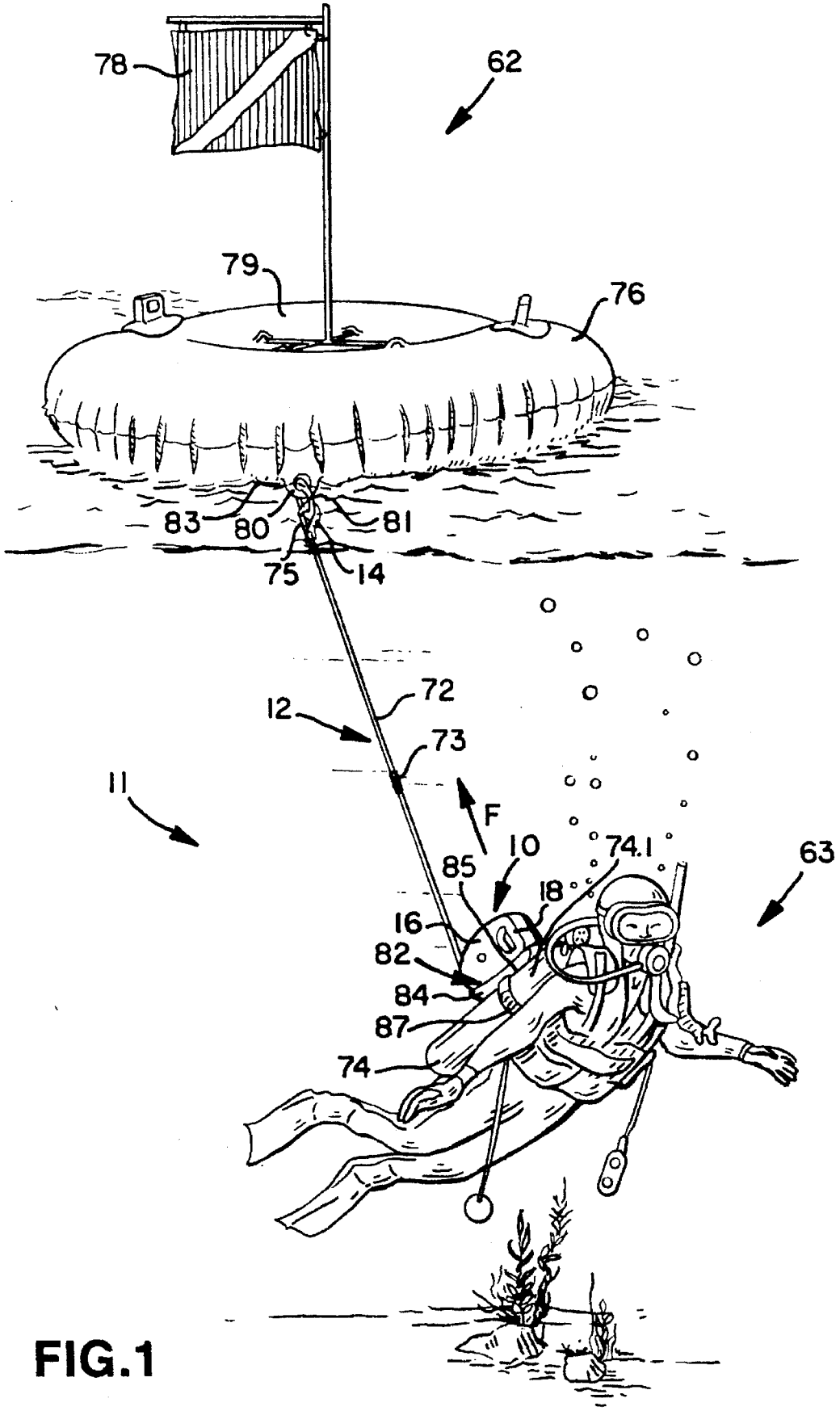
FIG. 1 is a perspective view of hands free dive flag connector connecting diver to dive flag.

FIG. 1 illustrates the hands free dive flag connector 11 comprises a lanyard dispenser 10, a lanyard 12, and a lanyard connector 14.

Figure 2:
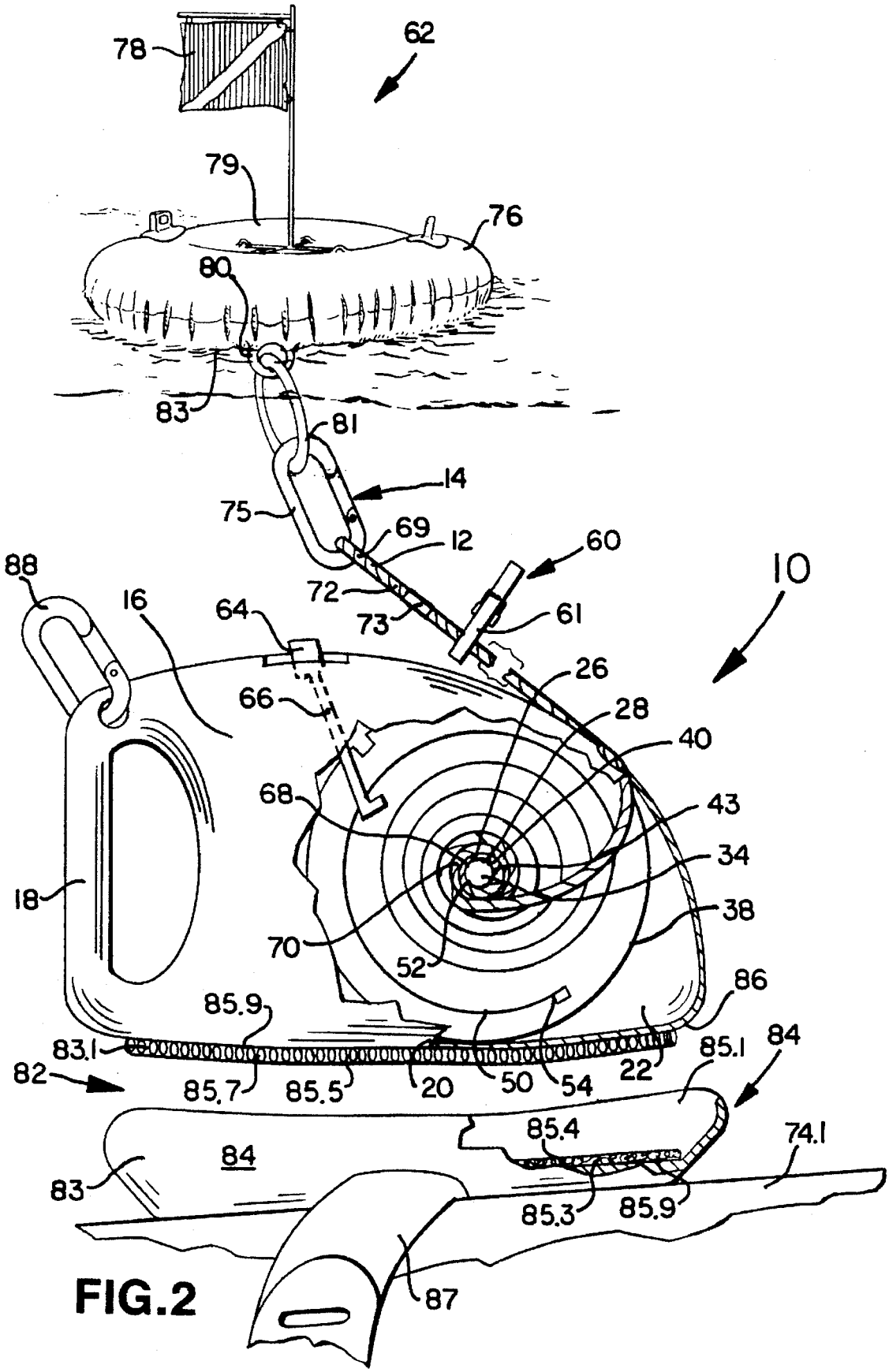
FIG. 2 a detail of retractable lanyard dispenser with a portion broken away to illustrate details.

The lanyard dispenser 10 shown in FIG. 2 comprises a housing 16, with sidewalls 20 and 22 and a handle 18. Sidewalls 20 and 22 each have an axle hole 26 and 28 respectively. An axle 34 extends through the axle holes 26 and 28. A spool 38 is pivotally attached to sidewalls 20, 22 by axle 34. The spool 38 has core 40 and spool axle hole 43 extending through spool core 40. Spring 50 is concentrically mounted about axle 34, Spring 50 bears against the housing 16 at the spring housing end 52 and bears against spool 38 at the spring spool end 54 to wind and store tension as force F is applied to lanyard 12 by diver swimming away from dive flag causing lanyard to be withdrawn from lanyard dispenser 10. Spring 50 unwinds and releases tension turning spool 38 to wind lanyard 12 about core 40 causing lanyard 12 to retract into retractable lanyard dispenser 10 as force F is released.

Lanyard dispenser also comprises a lanyard locking mechanism 60 on retractable lanyard dispenser 10 preventing lanyard 12 from being wound onto spool 38 by spring 50. In the preferred embodiment shown in FIG. 2, locking mechanism 60 is a plastic lanyard clip 61 that attaches to lanyard 12. A diver 63 attaches the lanyard clip 61 to lanyard 12 to allow for an unrestricted surface swim towing the dive flag 62 at a convenient distance. Alternatively, locking lever 64 on housing 16 stops spool 38 from rotating about axle 34. Locking lever 64 is pivotally attached to housing 16 at pivot pin 66. The housing 16 has lanyard hole 6 allowing lanyard 12 to enter and exit retractable lanyard dispenser 10.

Lanyard 12 is a rope or cord commonly used in scuba diving. Lanyard is made of polyethylene, nylon or other material that resists decay in a wet environment. Lanyard 12 has a dispenser end 68 and a second end 69. Dispenser end 68 is attached to spool 38 by tying a loop knot or other means commonly known in the art of attaching rope to a spool. A wound portion of lanyard 70, adjacent dispenser end 68, is wound on spool 38. Lanyard extended portion 72, adjacent second end 69, extends from the retractable lanyard dispenser 10. In the preferred embodiment, lanyard 12 has depth markings 73 at predetermined distances from second end. As shown in FIG. 1 depth marking 73 is at the 15-foot length from second end 69 to signal diver 63 has reached a predetermined depth for such activity as decompressing. It should be understood, wound portion and extended portion alternatively increase and decrease in length respectively as lanyard 12 is wound onto spool core 40 by spring 50. Alternatively, wound portion 70 and extended portion 72 alternatively decrease and increase in length respectively as lanyard 12 is unwound from spool core 40 by force F.

Figure 3:
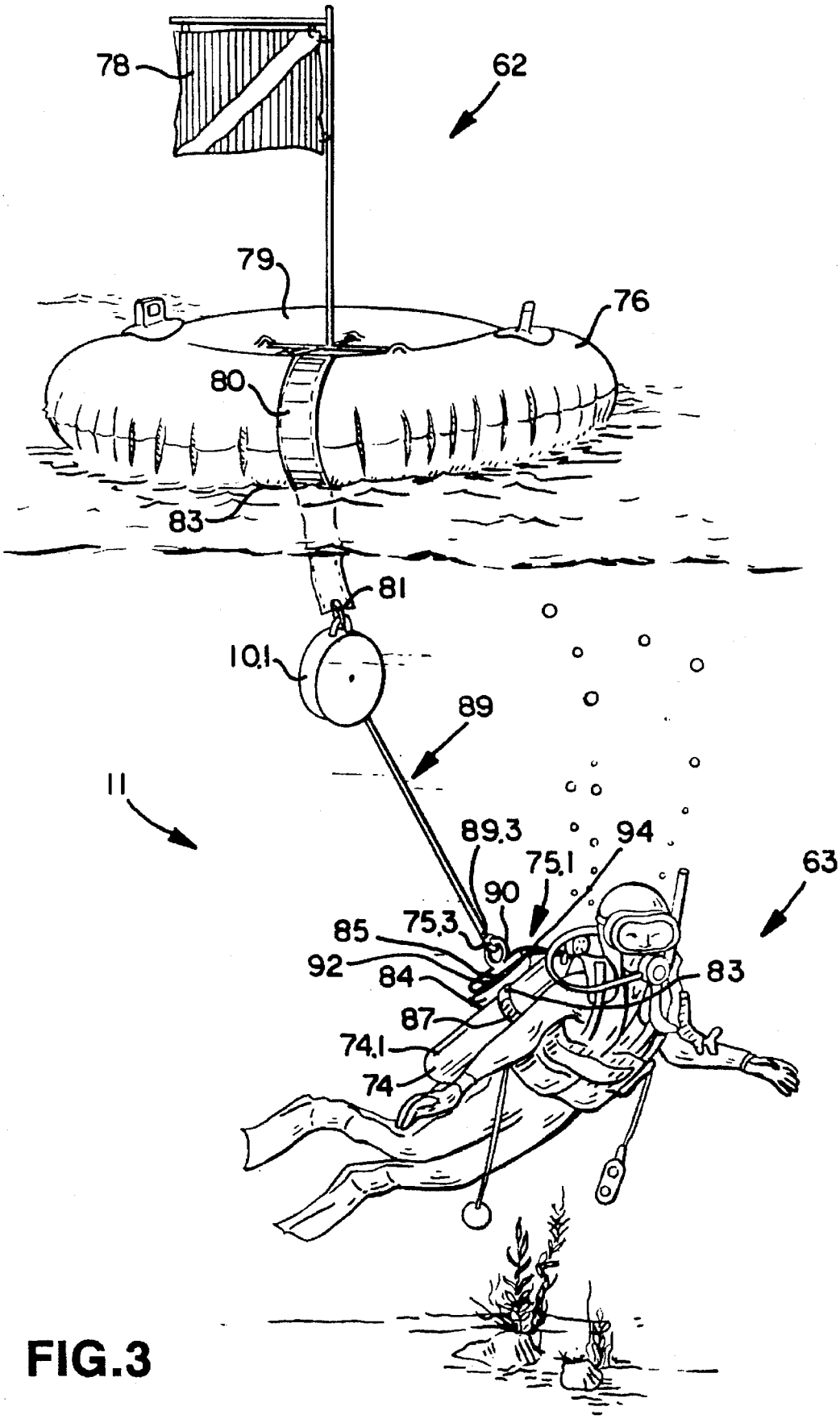
FIG. 3 a perspective view of alternate configuration with lanyard dispenser on dive flag.

Lanyard connector 14 is attached to lanyard second end 69. In the preferred embodiment lanyard connector 14 is a snap 75 made of high tensile plastic or stainless steel or other rust resisting material. Lanyard connector 14 may alternatively be a releasable connector means 75.1 formed of complementary hook and loop material as shown in FIG. 3, or other releasable connector having a predetermined release force. It should be understood the invention is directed to safety of the diver 63 if the lanyard 12 should become engaged by an object such as a passing boat or a tree in a river. The intent of the invention is to have the diver 63 release from the object.

The dive flag 62 is a standard scuba dive flag available from scuba suppliers. Dive flag 62 has a float 76 with a vertical flag 78 mounted on the top side 79. Dive flag connector 80 is on the underside 83 of flag 62 to connect to lanyard 12. Dive flag connector 80 may be a ring 81 or other connector means known in the art of connecting a lanyard 12. Lanyard connector 14 is attached to dive flag connector to connect diver 63 and dive flag 62.

Diver 63 has dive gear indicated in general by the numeral 74. In the preferred embodiment, the diving gear comprises a scuba tank 74.1. Lanyard dispenser connector means 82 releasably connects retractable lanyard dispenser 10 to scuba tank 74.1. Lanyard dispenser connector means 82 comprises a dive gear portion 83 and a hands free dive flag connector portion 83.1. Dive gear portion 83 comprises a retractor housing shoe 84 connected to scuba tank 74.1 by tank strap 87. Retractor housing shoe 84 may be attached to other parts of dive gear 74 or by other means such as tape, rope, adhesive, etc. Retractor housing shoe 84 has bottom 85.1 and side 85.2 surfaces. Dive flag connector portion 83.1 comprises a housing connect surface 86 releasably attached to dive gear portion 83. It should be understood, the dive gear portion 83 contacts a plurality of lanyard dispenser housing connect surfaces 86 to assure retractable lanyard dispenser 10 is releasably attached to dive gear. Complementary hook and loop material 85 such as sold under the trade name VELCRO® is placed between housing shoe 84 and housing connect surface 86. In the preferred embodiment shown in FIG. 2, a strip of hook material 85.3 having a plurality of minute hook like projections 85.4 extending therefrom is adhesively attached to bottom and side surfaces 85.1, 85.2 of housing shoe 84 having the adhesive backing 85.9 intermediate the hook-like projections and surfaces 85.1, 85.22 A complementary strip of loop material 85.5 having a plurality of minute fabric loops 85.7 is adhesively attached to housing connect surface 86 having adhesive backing 85.9 intermediate the fabric hoops 85.7 and the housing 16. Housing shoe may be flat as shown in FIG. 2 or comprise only hook material 85.3 on strap 87 attached to diving gear 74 as shown in FIG. 3.

Alternatively, dive gear portion 83 may be applied to other dive gear 74 portions. The releasable lanyard dispenser connector means 82 may alternatively be a releasable connector such as complementary magnetic materials, tape or other known releasable connecters having a predetermined release force to hold dive flag 62 to diver 63 while protecting diver 63 from being pulled by a passing object.

In the embodiment of FIG. 3, dive flag retractable lanyard dispenser 10.1 is attached to dive flag 62 with snap 88. Dive flag lanyard 89 has a second end 89.3. Lanyard connector 75.3 on dive flag lanyard second end 89.3 is a releasable connection means 75.1 comprising a diving gear ring 90 having a foot 92. Complementary hook and loop material 85 is attached between dive gear side of foot 94 and dive gear portion 83. It should be understood dive flag retractable dispenser 10.1 is essentially the same as retractable lanyard dispenser 10.

Figure 4:
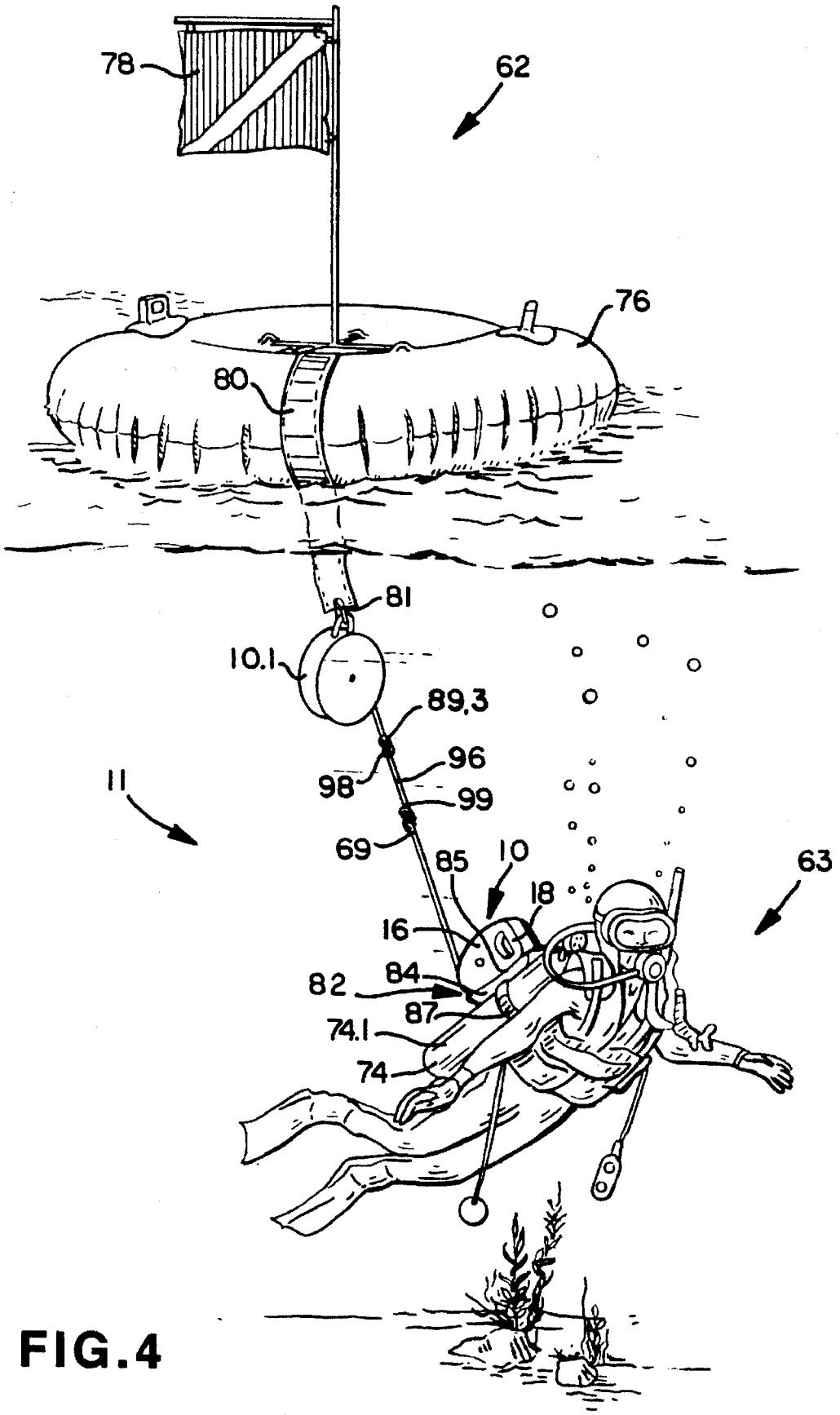
FIG. 4 perspective view shown two lanyard dispensers connecting diver to dive flag.

As illustrated in FIG. 4, hands free dive flag connector 11 alternatively comprises a dive flag retractable lanyard dispenser 10.1 on dive flag 62 and a retractable lanyard dispenser 10 releasably connected to dive gear 74. A lanyard extension 96 having an extension first end 98 connected to the dive flag lanyard second end 89.3, an extension second end 99 connected to the lanyard second end 69 and a predetermined length.

In operation, the diving gear portion 83 is connected to dive gear 74. In the preferred embodiment dive gear portion is attached on the tank 74.1 to direct the lanyard 12 away from the arms and legs of diver 63. Retractable lanyard dispenser 10 is releasably attached to diving gear portion 83 by pressing housing connect surface 86 into housing shoe 84 to mate the complementary pieces of hook and loop material 85 creating a releasable connection between diver 63 and flag 62. Lanyard connecter 14 is attached to dive flag 62. Lanyard extended portion is lengthened by pulling lanyard 12 from retractable lanyard dispenser 10. Locking mechanism 60 is attached to lanyard 12 to hold lanyard extended portion 72 from being retracted into housing 52 by spring 50.

Diver 63 swims on the surface of the water to a point where diving under the water begins. Locking mechanism 60 is released causing spring 50 to maintain tension on lanyard 12 between dive gear 74 and dive flag 62.

If more lanyard length is needed to swim deeper under dive flag 62 lanyard extension 96 is connected intermediate lanyard connecter 14 and dive flag connecter 80. At the end of the dive, diver 63 swims toward the surface of the water when retractable lanyard dispenser 10 has retracted lanyard 12 and second end 69 is bearing against lanyard hole 62, diver may pull lanyard extended portion to a predetermined length and engage locking mechanism 60 to allow dive flag 62 to follow diver on surface swim to shore or dive boat (not shown).

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

We claim:

1. A hands free dive flag connector for releasably attaching a diver having diving gear to a float, the hands free dive flag connecter comprising:

(a) a retractable lanyard dispenser, a means for connecting the dispenser and the dive gear, the means for connecting the dispenser and the dive gear having a predetermined release force; and (b) a lanyard having a dispenser end connected to the lanyard dispenser and a lanyard second end connected to the float whereby the lanyard dispenser may be separated from the dive gear by a predetermined force applied to the lanyard.

2. The invention of claim 1 the lanyard further comprising a wound lanyard portion adjacent the dispenser end, an extended lanyard portion adjacent the second end, and a locking mechanism on the lanyard dispenser.

3. The invention of claim 2 the lanyard dispenser further comprising a spool, a housing having a sidewall on the lanyard dispenser, the spool pivotally connected to the housing the wound lanyard portion retractably retained on the spool.

4. The invention of claim 1 the means for connecting comprising complimentary hook and loop materials on the diving gear and the retractable lanyard dispenser.

5. The invention in claim 1 further comprising a releasable lanyard connector on the second end, the lanyard connector engaged to the float, the lanyard connector having a predetermined release force whereby the lanyard is disconnected from the float by applying the predetermined release force.

6. The invention in claim 5, the lanyard connector further comprising complimentary hook material on the dive flag and loop material on the lanyard.

7. The invention in claim 1, further comprising a lanyard extension intermediate the dive gear and the float.

8. The invention in claim 1, further comprising:

(a) a dive flag lanyard dispenser on the float; and (b) a dive flag lanyard attached to the dive flag lanyard dispenser and further connected to the lanyard second end.

9. The invention in claim 8 further comprising a dive flag lanyard extension intermediate the float and the diver.

10. In combination with diving gear connected to a diver and a dive flag, a hands free dive flag connector comprising:

(a) a retractable lanyard dispenser comprising a housing;

(b) a shoe on the diving gear, and a lanyard dispenser connection means for connecting the lanyard dispenser and the shoe; and (c) a lanyard having a dispenser end connected to the lanyard dispenser and a second end connected to the dive flag.

11. The invention in claim 10, the means for connecting further comprising a strip of hook material on the shoe having a plurality of hooks extending therefrom, a strip of loop material on the housing having a plurality of loops extending therefrom, the hooks attached to the loops whereby the lanyard dispenser is attached to the dive gear.

12. The invention in claim 10 further comprising a lanyard extension between the dive flag lanyard second end and the dive flag.

13. A hands free dive flag connector for releasably connecting a diver having a scuba tank and a float, the dive flag connector comprising:

a) a dive flag lanyard dispenser on the float;

b) a lanyard having a first end connected to the dive flag lanyard dispenser and a second end connected to the diver; and c) a shoe on the scuba tank; and d) a means for releasably connecting the second end to the diver, the means for releasably connecting having a predetermined release force whereby the diver is disconnected from the float by the exposure to the lanyard of a predetermined release force.

14. The invention in claim 13, the means for releasably connecting further comprising complimentary hook and loop materials.

15. A hands free dive flag connector for connecting a diver having diving gear comprising a scuba tank to a float, the hands free dive flag connector comprising:

(a) a retractable lanyard dispenser having a housing, a spool and a pivotal mount on the housing, the spool pivotally engaged to the pivotal mount, a spring bearing against the spool and the housing, the spring alternatively winding and unwinding the spool as the spool pivots about the pivotal mount, (b) a lanyard having a dispenser end connected to the lanyard dispenser, a second end, a wound portion adjacent to the dispenser end, and an extended portion adjacent to the second end, the wound portion retractably retained on the spool, the spring urging the lanyard to wind onto the spool, a lanyard connecter on the lanyard second end, the lanyard connecter connected to the float; and (c) a shoe on the scuba tank, a means for releasably connecting the shoe and the housing having a predetermined release force whereby the diver is disconnected from the float by the exposure of the lanyard to the predetermined release force.

* * * * *